US005107758A

United States Patent [19]

Withers

[11] Patent Number: 5,107,758

[45] Date of Patent: Apr. 28, 1992

[54] ADAPTABLE POCKET PRINTER ATTACHMENT

[76] Inventor: Stephen D. Withers, 2111 Tiburon Dr., Carrollton, Tex. 75006

[21] Appl. No.: 656,602

[22] Filed: Feb. 19, 1991

[51] Int. Cl.[5] ..... B41F 15/18

[52] U.S. Cl. ..... 101/35; 101/126

[58] Field of Search ..... 101/35, 115, 126, 407.1, 101/474

[56] References Cited

U.S. PATENT DOCUMENTS

| | | | |
|---|---|---|---|
| 4,612,856 | 9/1986 | Jennings | 101/35 |
| 4,753,161 | 6/1988 | Kimball | 101/126 |
| 4,753,164 | 6/1988 | Barnes et al. | 101/126 |

OTHER PUBLICATIONS

Tracer Brochure, "Introducing Tracer", Jun. 21, 1985, pp. 1-10.

*Primary Examiner*—Edgar S. Burr
*Assistant Examiner*—Stephen R. Funk
*Attorney, Agent, or Firm*—Dennis T. Griggs

[57] ABSTRACT

A pocket printer attachment for use in combination with the printing platen of a conventional screen printing press includes a pocket platen which is mounted onto and vertically spaced above the printing platen. The pocket printer attachment includes a mounting bracket integrally formed with the pocket platen for positioning the pocket printer platen in printing alignment with a printing screen.

3 Claims, 2 Drawing Sheets

ADAPTABLE POCKET PRINTER ATTACHMENT

FIELD OF THE INVENTION

This invention relates generally to the art of screen printing, and more particularly, to a pocket printer attachment for use with screen printing machines.

BACKGROUND OF THE INVENTION

Screen printing is widely used in the process of applying artistic designs, logos, company names and the like upon various materials such as textiles, paper and articles of clothing using a screen printing press. Positioning various materials, especially articles of clothing, in such a manner as to only print a small design or logo in a specific location upon a garment surface has been a continuing problem. In particular, it has become a tedious and time consuming task to precisely align a shirt pocket so that a design or the like can be applied correctly to the pocket.

DESCRIPTION OF THE PRIOR ART

The known prior art includes a variety of devices used in screen printing. For example, screen printing machines are disclosed in the following U.S. Patents: U.S. Pat. Nos. 4,679,501; 4,388,862; 3,977,322; 4,753,161; 4,438,693; 4,753,164.

A screen printing press having members which restrict the movement of a cap such that the printing location on the cap is fixed is described in U.S. Pat. No. 4,753,161.

U.S. Pat. No. 4,753,164 describes an adjustable pocket printing platen for use with a silk screen press of the type having an adjustable printing platen for receiving and properly positioning a T-shirt or other garment thereon. A printing head is pivotally mounted above the platen and includes a screen holder. By pivoting the printing head downwardly to the printing platen, the silk screen design can then be applied directly on the platen-supported garment in the usual manner.

The top surface of the platen receives the printing screen when it is lowered to apply a screen design to the pocket on a garment. Consequently, it is necessary for the pocket to be aligned exactly on top of the small printing platen prior to applying the printing screen. The positioning of a pocket on the narrow top surface of the printing platen can result in the misalignment of the pocket. Conventional screen printing machines are available to allow for rapid printing, consequently enhancing the risk for misalignment of a garment. Thus, a need has arisen for a screen printing apparatus facilitating positioning a portion of a garment such as a pocket, sleeve or the like at a predetermined press location.

OBJECTS OF THE INVENTION

The principal object of the invention is to provide an auxiliary printing platen for use with a conventional screen printing press such that a shirt pocket or the like can be quickly aligned with ease and accuracy.

A related object of the present invention is to provide an adjustable attachment for use with a conventional screen printing press for securing a predetermined printing area of a garment against movement when using a multi-color press of the type which requires repeated application of a printing screen.

Yet another object of the invention is to provide a pocket printing attachment for use with a conventional screen printing press in which productivity is improved by stabilizing the position of the shirt pocket relative to a printing platen.

SUMMARY OF THE INVENTION

The screen printer attachment of the present invention is adapted for use in combination with the support platen of a conventional screen printing press. The printer attachment is releasably attached to a rear portion of the support platen. The printer attachment includes an auxiliary platen which is positioned above the top surface of the support platen thereby providing a space for insertion of the auxiliary platen into the pocket or sleeve of a shirt.

The screen printer attachment also includes a mounting bracket having top and bottom members and inner and outer sidewalls, preferably integrally formed with the auxiliary platen. The inner sidewalls provide offset space between the auxiliary platen and the planar top surface of the support platen. Also, the top member of the mounting bracket is engaged against the rear portion of the planar top surface of the support platen. The outer sidewall extends perpendicular to the top member and the bottom member such that the outer sidewall is engaged against the back marginal surface of the support platen. Moreover, the bottom member of the mounting bracket is positioned in parallel alignment with the rear portion of the planar bottom surface of the support platen. The bottom member includes at least one threaded opening in which a thumb screw fastener is received for securing and adjusting the position of the auxiliary platen relative to the support platen.

BRIEF DESCRIPTION OF THE DRAWINGS

The foregoing objects, features, and advantages of the invention will be fully understood when the following detailed description is read in conjunction with the accompanying drawings, in which.

DETAILED DESCRIPTION OF THE PREFERRED EMBODIMENT

Figure 1:
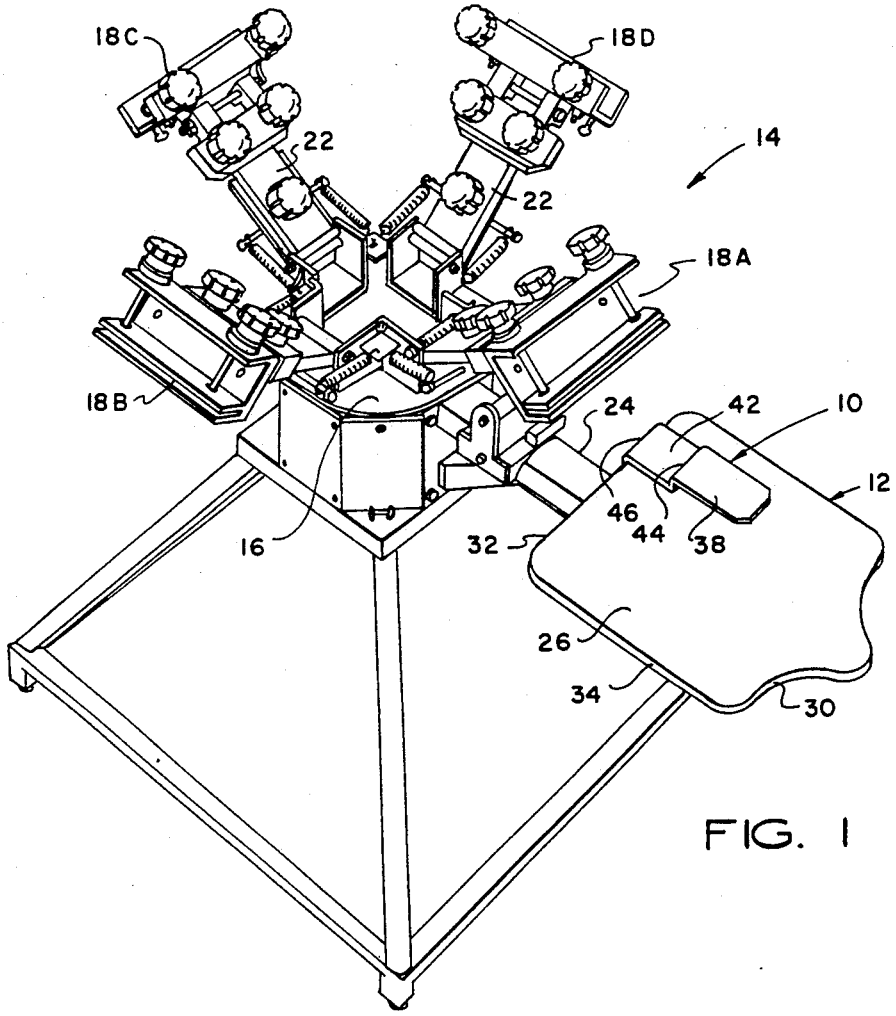
FIG. 1 is a perspective view of the auxiliary printer attachment of the present invention mounted onto the printing platen of a four color single station screen printing press.

In the description which follows, like parts are indicated throughout the specification and drawings with the same reference numerals, respectively. The drawings are not necessarily to scale and certain parts have been exaggerated to better illustrate details of the present invention.

The auxiliary printer platen of the present invention is particularly well-suited for use in connection with conventional screen printing machines.

Figure 3:
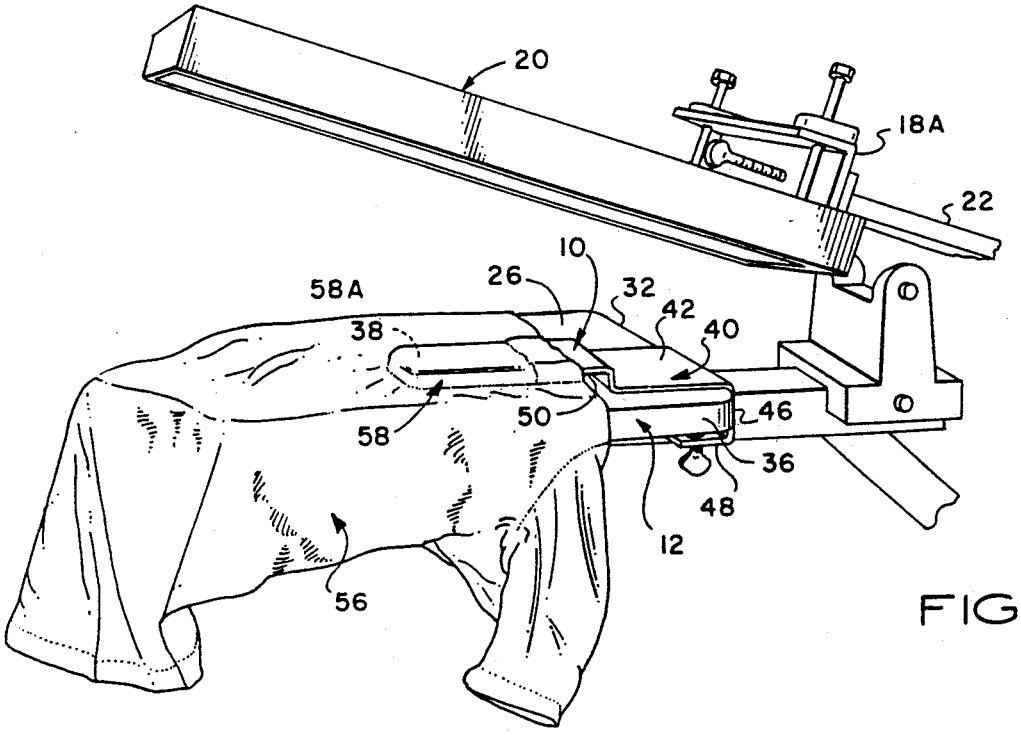
FIG. 3 is a perspective view showing the pocket platen of the pocket printer attachment inserted into the pocket of a T-shirt.
Figure 4:
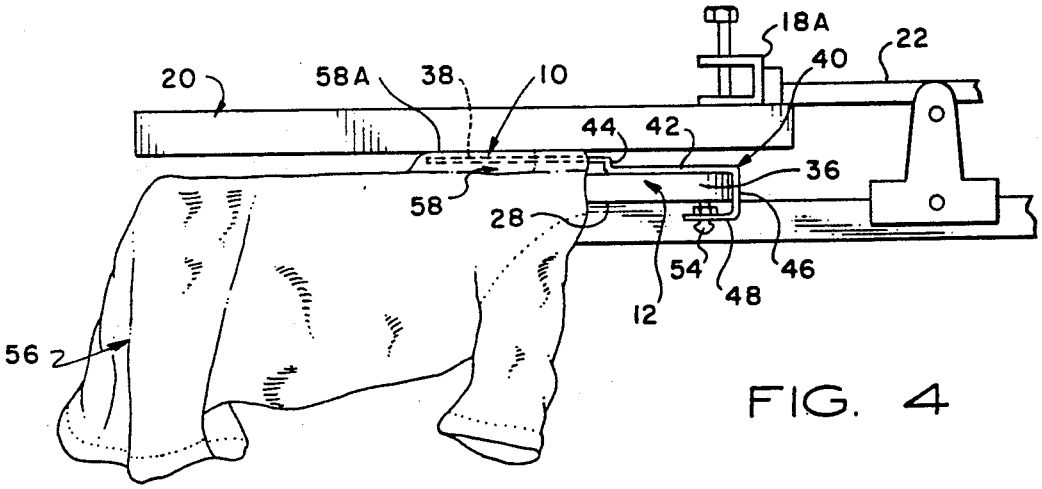
FIG. 4 is a side elevational view thereof.

Referring to FIG. 1, the auxiliary printer attachment of the present invention, generally designated by the numeral 10, is shown attached to a flat support platen 12 of a single station, four color screen printing press 14. The screen printing press 14, shown in FIG. 1, has a turntable 16 which supports four angularly spaced screen clamps 18A, 18B, 18C and 18D. Each clamp is designed to secure a printing screen 20 (FIG. 3, FIG. 4). Each printing screen 20 is supported by arms 22 which are pivotally connected to the turntable 16 so as to enable the printing screen 20 to be moved vertically from a retracted position, shown in FIG. 3, and lowered into a press position, shown in FIG. 4.

Referring again to FIG. 1 and FIG. 2, the screen printing press 14 further includes a radial arm 24 which supports the platen 12. Shown in FIGS. 1 and 2, the support platen 12 is mounted above the radial arm 24 such that when the printing screen 20 is lowered in its operative press position, the printing screen 20 will press against the support platen 12.

Figure 2:
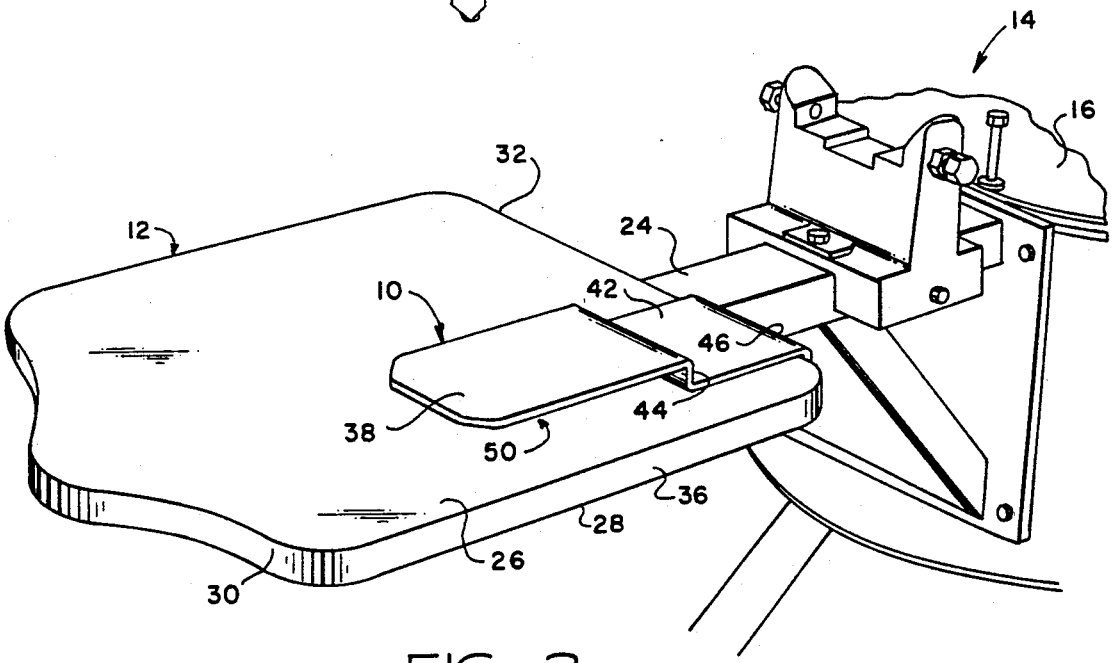
FIG. 2 is a close-up perspective view of the pocket printer attachment of FIG. 1.

As can best be seen in FIGS. 1 and 2, the support platen 12 of the screen printing press 14 has a planar top surface 26 and a planar bottom surface 28. Also, the support platen 12 has a front marginal surface 30, a back marginal surface 32 and left and right side surfaces 34 and 36 respectively.

Now referring to FIGS. 1, 2 and in particular FIG. 3, the auxiliary printer attachment 10 is seen in its preferred embodiment attached to a rear portion of the support platen 12 of the screen printing press 14. FIGS. 1, 2 and 3 show the auxiliary printer attachment 10 comprising a pocket platen 38 having first and second end positions and being of appropriate size to fit within a pocket, as shown in FIG. 3.

Figure 5:
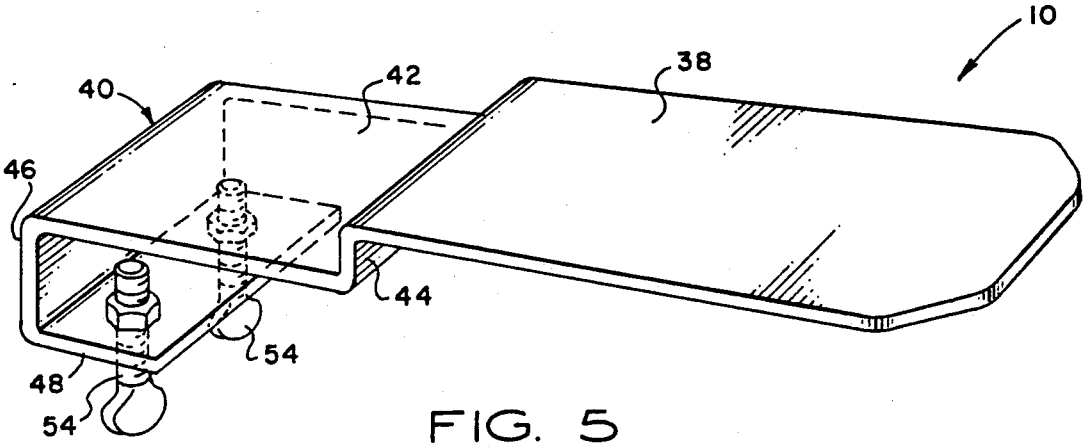
FIG. 5 is an enlarged perspective view of the adjustable pocket printing platen of the present invention.

According to the preferred embodiment of the present invention, the pocket attachment 10 includes a mounting bracket 40 integrally formed with the pocket platen 38. The mounting bracket 40 includes a top plate 42, an offset shoulder plate 44, a back plate 46 and a bottom plate 48, all shown in FIG. 5. The shoulder wall 44 is integrally formed with and perpendicularly offset to the second end portions of the pocket platen 38 and the top plate 42 of the mounting bracket 40 such that the shoulder 44 provides an offset space 50 between the pocket platen 38 and the planar top surface 26 of the support platen 12.

The top plate 42 of the mounting bracket 40 is positioned against the rear edge 32 of the support platen 12. In addition, shown in FIG. 5, the rear plate 46 is integrally formed with the top plate 42 and the bottom member 48 such that the rear plate 46 is engaged against the rear surface 32 of the support platen 12. Also, the bottom plate 48 of the mounting bracket 40 is positioned in parallel alignment with the top plate 42 and the planar bottom surface 28 of the support platen 12.

Referring again to FIG. 5, the bottom plate 48 of the mounting bracket 40 includes releasable mounting screws 54 for securing the pocket printer attachment 10 onto the support platen 12. A threaded opening is formed in the bottom plate 48 for threaded engagement therewith, for securing and adjusting the position of the pocket printer attachment 10 relative to the support platen 12 of a screen printing press 14.

In operation, a T-shirt 56 having a pocket 58 is positioned on the planar top surface 26 of the support platen 12 such that the first end portion of the pocket platen 38 of the auxiliary printer attachment 10 is inserted into the pocket 58, as shown in FIGS. 3 and 4. The space 50 provided between the printing platen 12 and the pocket platen 38 facilitates the insertion of the pocket 58. After the platen 38 has been completely inserted into the pocket 58, the printing screen 20 is rotated from its retracted position (FIG. 3) downwardly into printing engagement against the imprint surface 58A of pocket 58 (FIG. 4). Consequently, in its operative printing position, the printing screen 20 contacts in precise alignment with the raised surface to be imprinted, namely the pocket surface 58A.

After imprinting has been completed, the printing screen 20 is rotated upwardly to its retracted position. The T-shirt 56 and pocket 58 are removed from the support platen 12 and the pocket platen 38, respectively, if only a single color imprint is desired. For multiple color jobs, the turntable 16 is rotated and another printing screen 20 is brought around into printing alignment with the auxiliary printing platen, and the printing step is repeated for a second color, if desired.

While a preferred embodiment of the present invention has been shown and described herein, further modifications and improvements may be made by those skilled in the art. For example, the pocket platen 38 can be constructed of various shapes and sizes, such that any pocket-like shaped article or sleeve can be fitted thereon. The foregoing disclosure and description of the invention are illustrated in explanation thereof and various changes in the size, shape and materials as well as in the details of the illustrated construction may be made without departing from the spirit of the invention.

What is claimed is:

1. In a screen printing press of the type having a support platen for supporting a garment for printing engagement by a movable screen, the improvement comprising, in combination:

an auxiliary platen having a first end portion and a second end portion, the first end portion being disposed in offset spaced relation to said support platen and being sized to fit within a pocket or sleeve of a garment; and, a mounting bracket releasably attaching the second end portion of said auxiliary platen to said support platen, with the first end portion of the auxiliary platen projecting in cantilevered offset relation with respect to said support platen.

2. A pocket printer attachment for use in combination with a screen printing press of the type having a support platen, the support platen having top and bottom surfaces, the pocket printer attachment being releasably attachable to said support platen, said pocket printer attachment comprising:

a pocket platen having a first end portion and a second end portion, the first end portion being adapted for insertion into a pocket of a garment; and a mounting bracket attached to the second end portion of said pocket platen, said mounting bracket including a top plate for engaging the top platen surface, a bottom plate for engaging the bottom platen surface, a rear plate connecting the top and bottom plates in offset spaced relation, and a shoulder plate connecting the top plate and the second end portion of said pocket platen in offset spaced relation, thereby establishing a space for receiving a garment between said pocket platen and the top surface of said support platen when said mounting bracket is attached thereto, with the first end portion of the pocket platen projecting in cantilevered relation with respect to said support platen.

3. A pocket printer attachment for use in combination with a screen printing press of the type having a support platen, the support platen having top and bottom surfaces, the pocket printer attachment being releasably attachable to said support platen, said pocket printer attachment comprising:

a pocket platen having a first end portion and a second end portion, the first end portion being adapted for insertion into a pocket of a garment; and, a mounting bracket adapted for releasably attaching the second end portion of said pocket platen to said support platen in offset relation, thereby establishing a space for receiving a garment between said pocket platen and the top surface of said support platen when said mounting bracket is attached thereto, with the first end portion of the pocket platen projecting in cantilevered offset relation with respect to said support platen.

* * * * *